US005435757A

United States Patent [19]

Fedder et al.

[11] Patent Number: 5,435,757

[45] Date of Patent: Jul. 25, 1995

[54] CONTACT AND ALIGNMENT FEATURE

[75] Inventors: James L. Fedder, Etters; John R. Shuey, Mechanicsburg, both of Pa.

[73] Assignee: The Whitaker Corporation, Wilmington, Del.

[21] Appl. No.: 97,528

[22] Filed: Jul. 27, 1993

[51] Int. Cl.[6] ..... H01R 13/502

[52] U.S. Cl. ..... 439/686

[58] Field of Search ..... 439/682, 497, 494, 499, 439/101, 108, 743, 856, 857, 525, 686

[56] References Cited

U.S. PATENT DOCUMENTS

| | | | |
|---|---|---|---|
| 3,149,893 | 9/1964 | Dupre . | |
| 3,602,875 | 8/1971 | Pierini | 439/525 |
| 4,066,316 | 1/1978 | Rollings . | |
| 4,215,236 | 7/1980 | Reiser | 174/59 |
| 4,310,208 | 1/1982 | Webster et al. | 339/14 R |
| 4,379,361 | 4/1983 | Webster et al. | 29/857 |
| 4,506,940 | 3/1985 | Asick et al. . | |
| 4,558,917 | 12/1985 | Kamono et al. . | |
| 4,571,014 | 2/1986 | Robin et al. . | |
| 4,587,028 | 5/1986 | Darden | 252/76 |
| 4,602,831 | 7/1986 | Lockard . | |
| 4,611,867 | 9/1986 | Ichimura et al. . | |
| 4,632,476 | 12/1986 | Schell . | |
| 4,655,515 | 4/1987 | Hamsher, Jr. et al. . | |
| 4,655,518 | 4/1987 | Johnson et al. . | |
| 4,707,040 | 11/1987 | Hansel, III | 439/510 |
| 4,711,506 | 12/1987 | Tanaka | 439/108 |
| 4,712,849 | 12/1987 | Seidel et al. | 439/607 |
| 4,743,208 | 5/1988 | Weisenburger | 439/398 |
| 4,747,787 | 5/1988 | Siwinski | 439/108 |
| 4,762,500 | 8/1988 | Dola et al. | 439/79 |
| 4,773,881 | 9/1988 | Adams, III | 439/681 |
| 4,808,115 | 2/1989 | Norton et al. | 439/79 |
| 4,846,727 | 7/1989 | Glover et al. | 439/608 |
| 4,867,707 | 9/1989 | Widdoes | 439/675 |
| 4,869,677 | 9/1989 | Johnson et al. | 439/80 |
| 4,975,069 | 12/1990 | Fedder et al. | 439/497 |
| 4,984,992 | 1/1991 | Beamenderfer et al. | 439/108 |
| 4,997,376 | 3/1991 | Buck et al. | 439/660 |
| 5,030,138 | 7/1991 | Capp et al. | 439/497 |

FOREIGN PATENT DOCUMENTS

| | | |
|---|---|---|
| 61-150629 | of 1986 | Japan . |
| 2027290 | 2/1980 | United Kingdom . |

OTHER PUBLICATIONS

"IBM Technical Disclosure Bulletin," Shielded In--Line Electrical Multiconnector, vol. 10, No. 3, Aug. 1967, p. 203.

"The Demands of Logica and Power on Back Planes" Electronic Engineering 60 (1988) Apr., No. 736., pp. 53, 56, 60.

*Primary Examiner*—Gary F. Paumen
*Assistant Examiner*—Hien D. Vu
*Attorney, Agent, or Firm*—Kevin D. McCarthy

[57] ABSTRACT

An electrical connector comprises, an insulative housing block (2), electrical contacts (4) held by the housing block (2), spring fingers (11) on each of the contacts (4) for gripping onto a conductive pin, cavities (6) in an insulating housing (5) for receiving the fingers (11), mouths (19) opening into the cavities (6) for receiving conductive pins to be gripped by the spring fingers (11), rails (21) in the cavities (6), each of the rails (6) being in between said spring fingers (11) of one of the contacts (4), and each of the rails (21) being aligned with a mouth (19) of one of the cavities (4) and positioning said spring fingers (11) in alignment laterally with respect to the mouth (19) to assure receipt of a conductive pin between said spring fingers (11).

8 Claims, 5 Drawing Sheets

FIG. 2
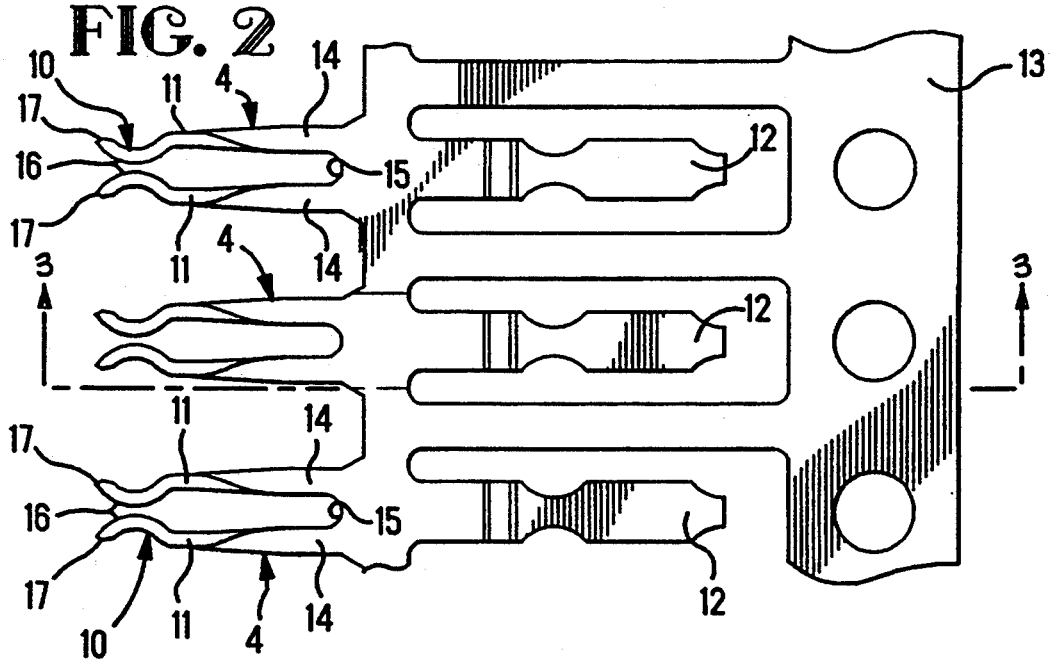
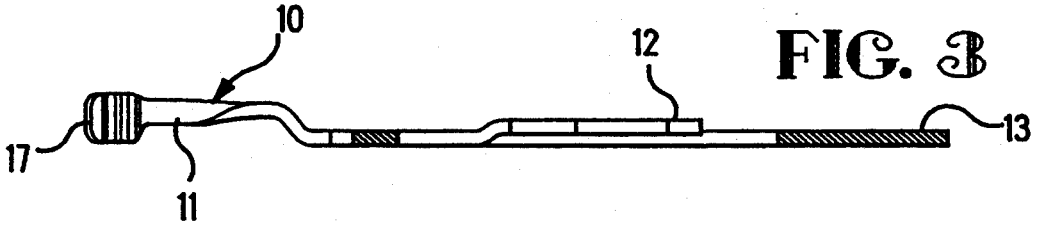
FIG. 3
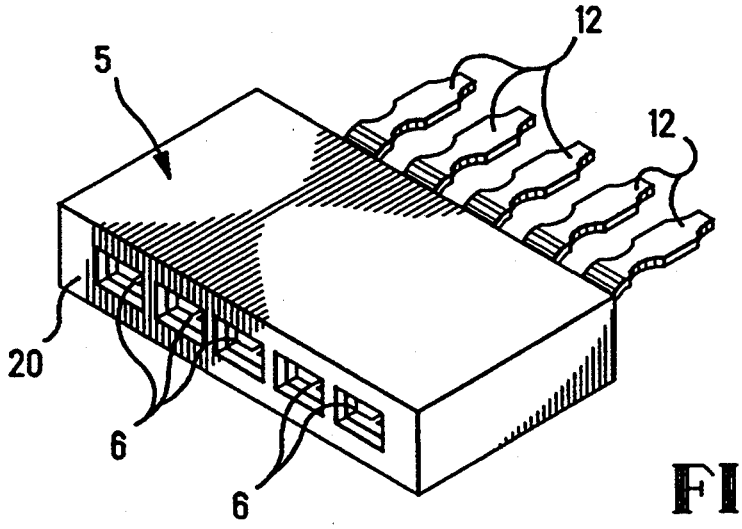
FIG. 4

CONTACT AND ALIGNMENT FEATURE

FIELD OF THE INVENTION

The invention relates to an electrical connector and, more particularly, to a contact and alignment feature for an electrical connector.

BACKGROUND OF THE INVENTION

An electrical connector known from U.S. Pat. No. 4,984,992, (14676) comprises, an insulative housing block, electrical contacts held by the housing block, spring fingers on each of the contacts for gripping onto a conductive pin, and cavities in an insulating housing for receiving the fingers. The pin extends into a mouth of the cavity, the spring fingers are inserted into the cavity and grip onto the conductive pin.

The pin can be misaligned in the mouth of the cavity, to an extent that a misaligned pin will be struck by the fingers, causing damage to the fingers, and preventing the pin to be gripped by the fingers. Alternatively, the contact can be misaligned when inserted into the cavity, causing the fingers to strike the pin and become damaged.

A damaged contact is not easily replaced, especially when the contact has been welded to a corresponding wire, and when the insulative housing block has been applied to the contact by a process that molds the insulative housing block directly onto the contact. Usually a damaged contact will require waste disposal of all the wires and contacts to which the molded housing block has been directly applied.

SUMMARY OF THE INVENTION

The invention resides in a feature that aligns spring fingers of an electrical contact relative to a mouth of a cavity in an insulating housing. When a misaligned pin is received in the mouth of the cavity, or, alternatively, when the contacts are misaligned, the feature aligns the spring fingers to avoid the fingers from being struck against a pin.

A feature of the invention resides in a rail in each contact receiving cavity, each of the rails being in between said spring fingers of the contact, and the rail being aligned with a mouth of the cavity and positioning said spring fingers in alignment with the mouth to assure receipt of a conductive pin between said spring fingers.

DESCRIPTION OF THE DRAWINGS

An embodiment of the invention will now be described by way of example, with reference to the accompanying drawings, according to which:

FIG. 2 is a top plan view of signal contacts connected by a carrier strip;

FIG. 3 is a side view of the structure as shown in FIG. 2;

FIG. 4 is an isometric view of electrical contacts which have been removed from a carrier strip in combination with an insulative housing having contact receiving cavities;

DETAILED DESCRIPTION

Figure 1:
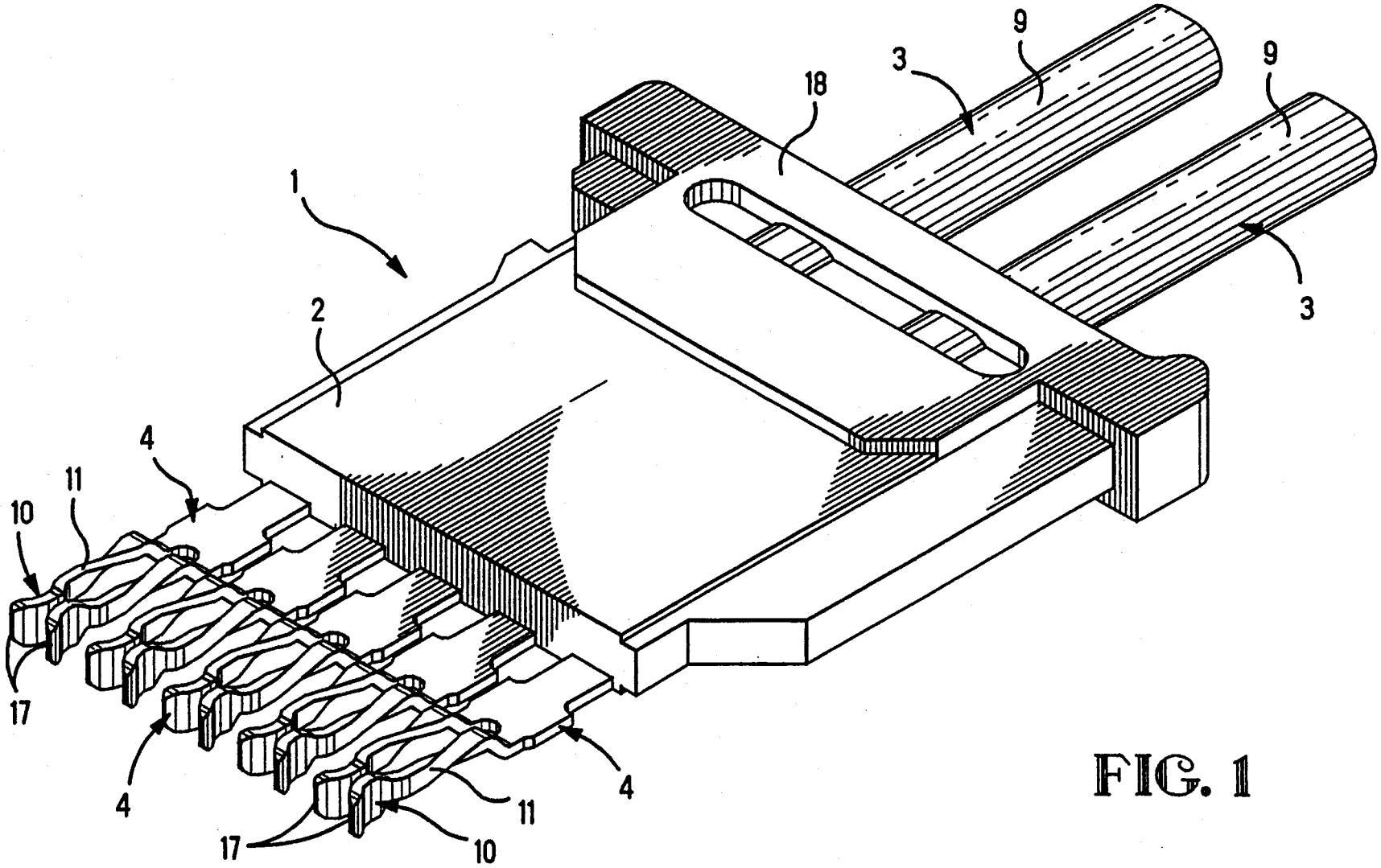
FIG. 1 is an isometric view of a cable connector.
Figure 7:
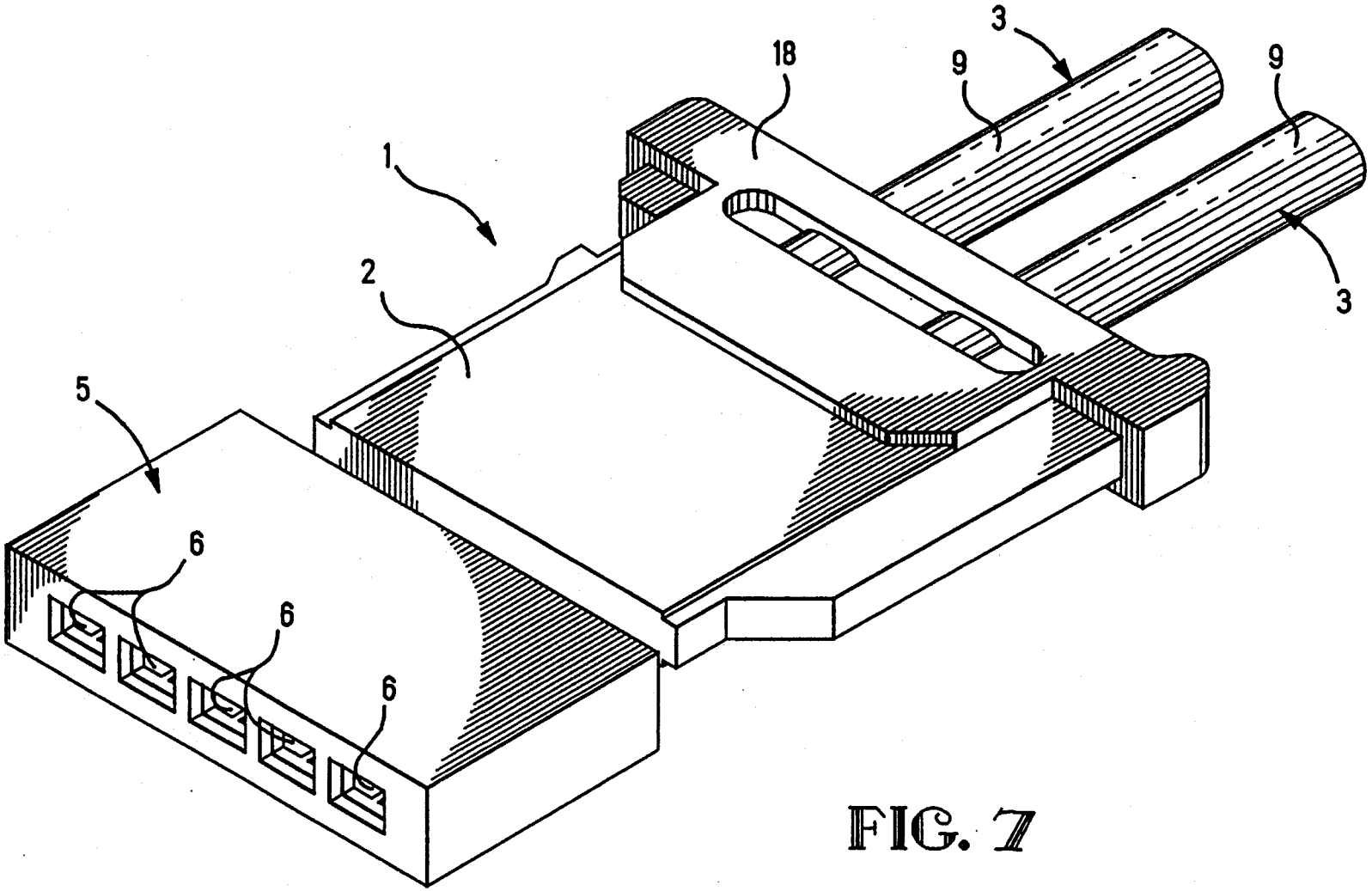
FIG. 7 is an isometric view of a housing block combined with the connector as shown in FIG. 1.
Figure 8:
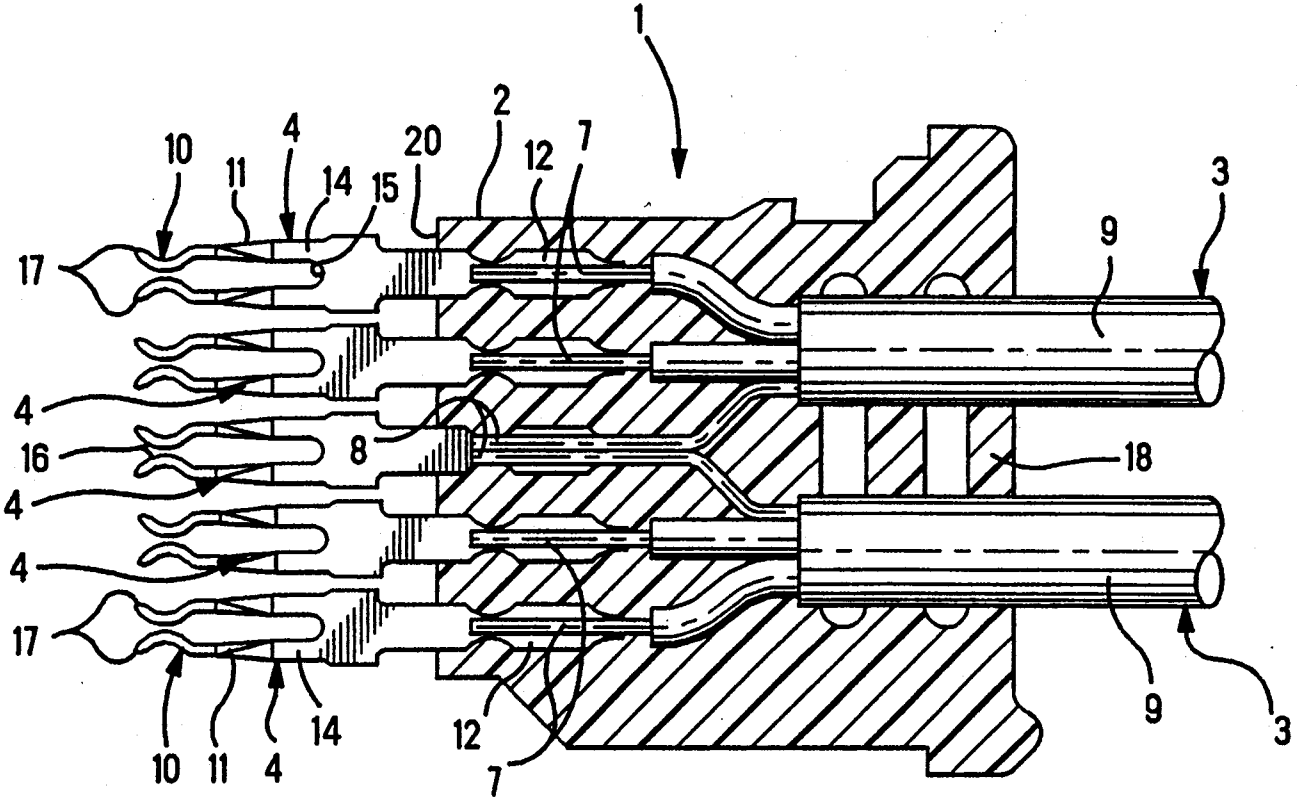
FIG. 8 is a longitudinal section view of the structure shown in FIG. 7.

With reference to FIG. 1, a cable connector 1 comprises, a housing block 2, at least one electrical cable 3, although two are disclosed, connected to conductive electrical contacts 4 in a row, and an insulating housing 5, FIG. 7, containing contact receiving cavities 6. A representative cable 3 has at least one signal wire 7, although two are shown, and at least one ground, or reference, wire 8 for connection to a reference electrical potential, not shown. Each signal wire 7 is insulated. Each reference wire 8 is beside an insulated signal wire 7, and may be in contact with electrical shielding, not shown, that encircles the insulated signal wire 7 and the ground wire 8. An insulative jacket 9 of a corresponding cable 3 covers the shielding. The central one of five of the multiple contacts 4 is a ground contact, and is connected to the reference wire 8 of each of the cables 3. The remaining contacts 4 in the row are signal contacts connected to respective signal wires 7. Connection of the contacts 4 to the respective, signal wires 7 and the reference wires 8 is accomplished by welding or soldering, for example.

With reference to FIGS. 2 and 3, each contact 4 is of unitary, stamped and formed construction, and includes a front electrical receptacle 10 formed between two opposed, spring resilient spring fingers 11, and a rear, wire connecting portion 12 connected to a signal wire 7 or a ground wire 8, in the manner as desired previously. Initially, each contact 4 is joined removeably with a carrier strip 13. Mutually coplanar portions 14 of the spring fingers 11 extend forward from a planar web 15 joining the spring fingers 11. Forward of the coplanar portions 14 of the spring fingers 11, the lengths of the spring fingers 11 are twisted ninety degrees from the plane of the web 15 to provide curved contact surfaces 16 opposing each other. In this manner, the contacts 4 remain slender, and are constructed especially for placement closely on pitch spacings side to side. Each contact 4 is made from relatively thin metal strip, gaining stiffness and spring strength in the spring fingers 11 from the twisted configuration. Front tips 17 of the spring fingers 11 curve outwardly from each other to provide a flared entry for receipt of a slender, conductive pin, not shown, between the contact surfaces 16. The spring fingers 11 are for the well know use to grip a conductive pin on opposite sides to provide an electrical connection between the contact 4 and the pin. Examples of such a pin are disclosed in U.S. Pat. No. 4,984,992.

With reference to FIG. 4, the contacts 4 are separated from the carrier strip 13, and are inserted along respective cavities 6 in the housing 5. The wire connecting portions 12 of the contacts 4 project from the housing 5 for connection to respective signal, wires 7 and ground wires 8. With reference to FIG. 7, following connection of the contacts 4 to the respective, signal wires 7 and the ground wires 8, the housing block 2 is applied over the wire connecting portions 12 of the contacts 4 where they are connected to the signal wires 7 and ground wires 8. A strain relief portion 18 of the housing block 2 is applied to encircle exteriors of the cables 3 to provide a strain relief. The housing block 2 is an insulative plastics material that is applied by being injection molded, for example, to cover the wire connecting portions 12 and encircle the cables 3.

Figure 5:
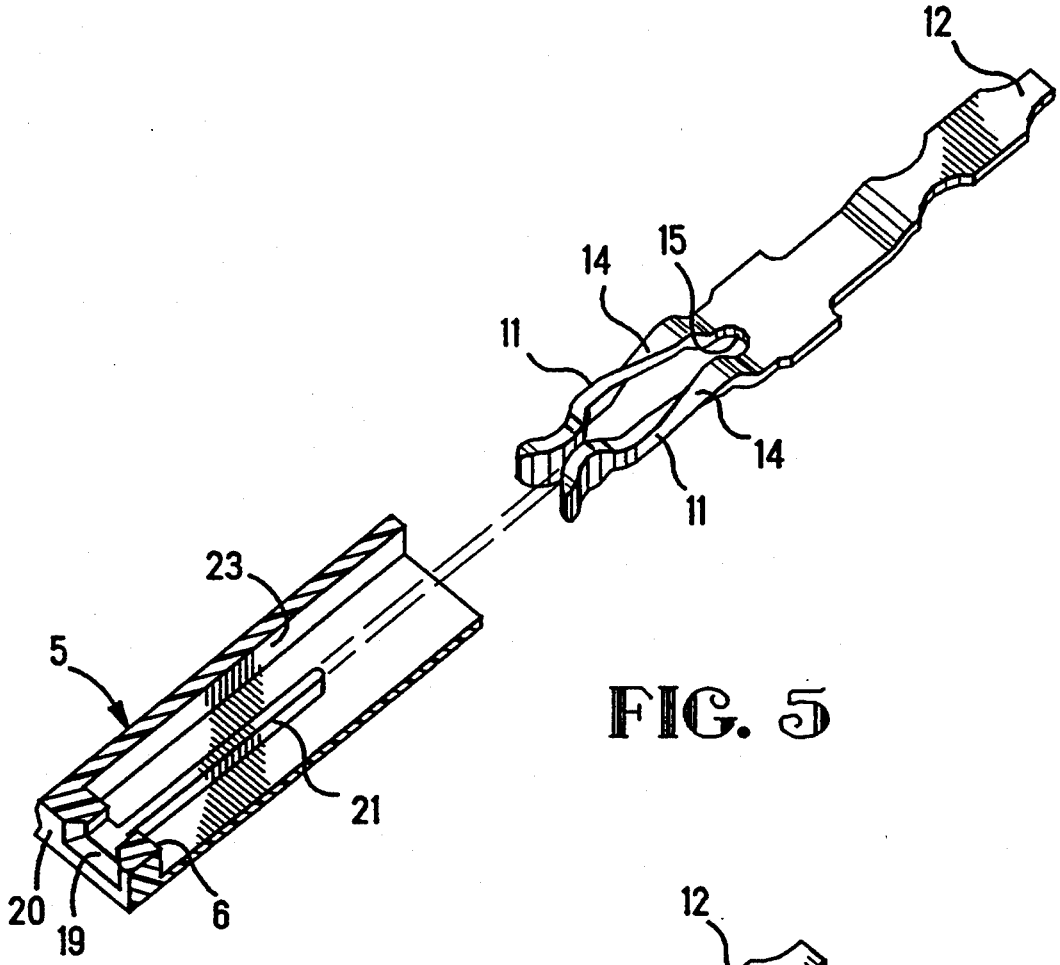
FIG. 5 is an isometric view of a portion of the structure shown in FIG. 4, with parts separated from one another, and with parts shown cut away and removed.
Figure 6:
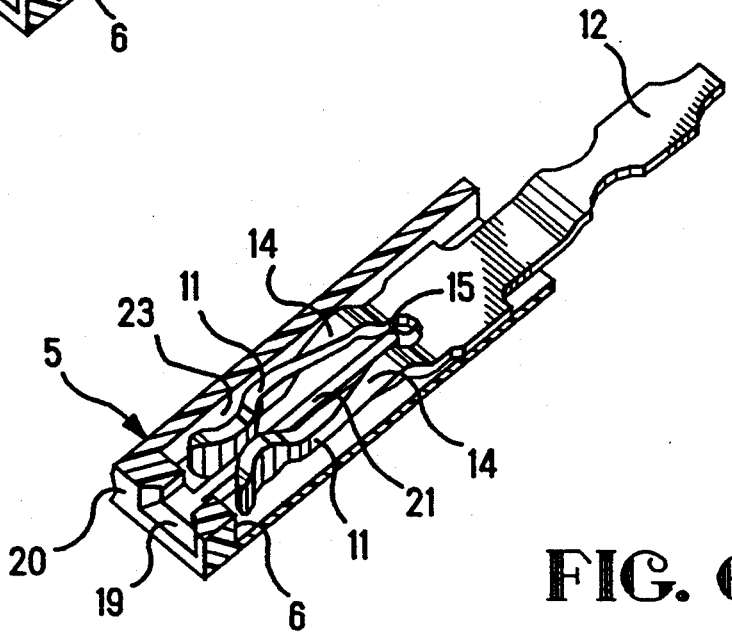
FIG. 6 is a view similar to FIG. 5, with the parts assembled together.

With reference to FIGS. 5, 6 and 7, the contacts 4 extend along the cavities 6 in the housing 5 from rear to front. Flared mouths 19 of the cavities 6 communicate with a front 20 of the housing 2. A slender rail 21 extends from each of the mouths 20 to project longitudinally along an interior of a corresponding cavity 6. For example, each rail 21 is unitary with the housing 5 that is of unitary, molded plastics construction. When a contact 4 is inserted along a cavity 6, FIGS. 5 and 6, a rail 21 in the cavity 6 is received in between said spring fingers 11 of the contact 4. The rail 21 is shorter than the length of the spring fingers 11 extending from the web 15 that joins the spring fingers 11.

Each rail 21 is a partition in a cavity 6 that confines the spring fingers 11 of a contact 4 to one side or the other of the centerline of the mouth 19. Even if a contact 4 is misaligned from extending straight into a cavity 6, the rail 21 in the cavity 4 will confine the spring fingers 11 from being bent or dislodged to lie across the mouth 19 to an extent that the flared entry of the contact 4 will become misaligned with the mouth 19 of the cavity 6.

The mouths 19 open into the cavities 6 for receiving conductive pins to be gripped by the spring fingers 11 that are positioned behind the mouth 19. The spring fingers 11 on each of the contacts 4 receive both a rail 21 and a conductive pin, and the spring fingers 11 grip the conductive pin. The spring fingers 11 of each contact 4 are biased apart by the pin received therebetween. A space 22 between the spring fingers 11 and interior sides 23 of the cavity 6 allow movement of the fingers 11 when they are biased apart. Each of the rails 21 is aligned with a mouth 19 of one of the cavities 6 and positions said spring fingers 11 in alignment with the mouth 19 to assure receipt of a conductive pin between said spring fingers 11. The contact surfaces on the spring fingers are wider than the rails. A space between the spring fingers 11 on each contact 4 is greater in width than the thickness of a rail 21 being in between the spring fingers 11. Each of the rails 21 is fitted loosely in the space between the spring fingers 11 of one of the contacts 4, when the contacts 4 are aligned properly in the cavities 6.

We claim:

1. An electrical connector comprising: an insulative housing block, electrical contacts held by the housing block, each of said electrical contact comprising spring fingers that have coplanar portions extending forward from a planar web joining the spring fingers, and forward of said coplanar portions the lengths of the spring fingers are twisted ninety degrees from the plane of the web, said spring fingers on each of the contacts for gripping onto a conductive pin, a discrete insulating housing having cavities for receiving the spring fingers, said cavities having mouths for receiving conductive pins to be gripped by the spring fingers, and rails in the cavities, each of the rails being in between said spring fingers of one of the contacts, and each of the rails being aligned with a corresponding mouth of one of the cavities and positioning said spring fingers in alignment laterally with respect to the mouth to assure receipt of a corresponding conductive pin between said spring fingers.

2. An electrical connector as recited in claim 1, wherein each of the rails extends from a mouth of one of the cavities.

3. An electrical connector as recited in claim 1, wherein each of the rails is fitted loosely in a space between said spring fingers of one of the receptacles.

4. An electrical connector as recited in claim 1, wherein the spring fingers on each of the contacts receives both a rail and a conductive pin, and the spring fingers grip the conductive pin.

5. An electrical connector as recited in claim 1, wherein contact surfaces on the spring fingers are wider than the rails, and a space between the spring fingers on each contact is greater than the thickness of a rail being in between the spring fingers.

6. An electrical connector assembly as recited in claim 1, wherein the rails are insulating and are unitary with the housing.

7. An electrical connector assembly as recited in claim 1, wherein, a space between the spring fingers and interior sides of the cavity allow movement of the spring fingers when they are biased apart by a pin received between the spring fingers.

8. An electrical connector assembly as recited in claim 1, wherein, each rail is a partition in a cavity that confines the spring fingers of a contact to one side or the other of the centerline of the mouth.

* * * * *